US007926805B2

(12) United States Patent
Ueyama

(10) Patent No.: US 7,926,805 B2
(45) Date of Patent: Apr. 19, 2011

(54) SHEET FEEDING UNIT AND IMAGE FORMING APPARATUS

(75) Inventor: Junki Ueyama, Aichi (JP)

(73) Assignee: Brother Kogyo Kabushiki Kaisha, Nagoya, Aichi (JP)

( * ) Notice: Subject to any disclaimer, the term of this patent is extended or adjusted under 35 U.S.C. 154(b) by 0 days.

(21) Appl. No.: 12/408,743

(22) Filed: Mar. 23, 2009

(65) Prior Publication Data

US 2009/0243206 A1 Oct. 1, 2009

(30) Foreign Application Priority Data

Mar. 26, 2008 (JP) ..... 2008-080626

(51) Int. Cl.
*B65H 1/00* (2006.01)

(52) U.S. Cl. ..... 271/162; 271/145; 271/157

(58) Field of Classification Search ..... 271/157, 271/145, 147, 162, 163, 164
See application file for complete search history.

(56) References Cited

U.S. PATENT DOCUMENTS

| | | | | |
|---|---|---|---|---|
| 3,563,535 | A * | 2/1971 | Vitu et al. | 271/157 |
| 4,786,042 | A * | 11/1988 | Stemmle | 271/9.1 |
| 5,096,182 | A * | 3/1992 | Kashimura | 271/170 |
| 5,201,511 | A * | 4/1993 | Kim | 271/127 |
| 5,564,690 | A * | 10/1996 | Oshida | 271/157 |
| 7,448,613 | B2 * | 11/2008 | Takahashi | 271/157 |
| 7,497,434 | B2 * | 3/2009 | Park | 271/127 |
| 2004/0036207 | A1 * | 2/2004 | Lee et al. | 271/157 |

FOREIGN PATENT DOCUMENTS

| | | | |
|---|---|---|---|
| JP | 3-138229 | * | 6/1991 |
| JP | 4-173628 | * | 6/1992 |
| JP | 4-217530 | * | 8/1992 |
| JP | 4-341436 | * | 11/1992 |
| JP | 5-294471 | A | 11/1993 |
| JP | 3000581 | U | 6/1994 |
| JP | 06-191655 | | 7/1994 |
| JP | 06-247568 | | 9/1994 |
| JP | 6-247568 | A | 9/1994 |
| JP | 2007-091440 | A | 4/2007 |

OTHER PUBLICATIONS

Notification of Reasons of Rejection issued Jan. 19, 2010 in the JP counterpart application No. 2008-080626.

* cited by examiner

*Primary Examiner* — Stefano Karmis
*Assistant Examiner* — Thomas A Morrison
(74) *Attorney, Agent, or Firm* — Banner & Witcoff, Ltd

(57) ABSTRACT

A sheet feeding device to feed sheets in a sheet feeding path is provided. The sheet feeding device includes a sheet cassette, in which a stack of sheets is stored, a body, in which the sheet cassette is removably installed, a feeder unit to forward the sheets in the stack in the sheet feeding path, at least one restrictive member, which is configured to be shifted between a releasing position and a restricting position and restricts a height of the stack of sheets to be stored in the sheet cassette when in the restricting position, a shifting unit to shift the positions of the at least one restrictive member. The shifting unit shifts the at least one restrictive member to be in the restricting position when the sheet cassette is removed from the body and to be in the releasing position when the sheet cassette is installed in the body.

16 Claims, 9 Drawing Sheets

〔 RELEASING POSITION 〕

〔 RESTRICTING POSITION 〕

WHEN INSTALLING SHEET CASSETTE

INSTALLED

SHEET FEEDING UNIT AND IMAGE FORMING APPARATUS

CROSS REFERENCE TO RELATED APPLICATION

This application claims priority from Japanese Patent Application No. 2008-080626, filed on Mar. 26, 2008, the entire subject matter of the which is incorporated herein by reference.

BACKGROUND

1. Technical Field

An aspect of the present invention relates to a sheet feeding device and an image forming apparatus with the sheet feeding device.

2. Related Art

An image forming apparatus to form an image on a recording sheet is often provided with a mechanism to prevent a sheet feeding device thereof from being overloaded with an excessive amount of recording sheets. For example, Japanese Patent Provisional Publication No. H06-191655 discloses an image forming apparatus having a sheet feeding cassette with an intercepting member, which can be rotated about a front edge of the cassette so that the intercepting member restricts the excessive amount of sheets from being loaded in the cassette. According to the disclosure, when the excessive amount of sheets is set in the cassette, the intercepting member is uplifted and rotated by the stack of sheets; therefore, the sheet feeding device interferes with the intercepting member so that the cassette with the excessive amount of sheets is not set in the sheet feeding device of the image forming apparatus.

SUMMARY

However, the image forming apparatus configured as above may permit the cassette with the excessive amount of sheets to be installed when the stack of sheets is forcibly compressed in the cassette. When the excessive amount of sheets is forcibly installed, it is highly likely that the sheets are jammed in the sheet feeding device, and a printing operation is interfered.

In view of the above drawbacks, the present invention is advantageous in that an image forming apparatus, in which overload of recording sheets is prevented, is provided.

According to an aspect of the present invention, a sheet feeding device to feed sheets in a sheet feeding path is provided. The sheet feeding device includes a sheet cassette, in which a stack of sheets is stored, a body, in which the sheet cassette is removably installed, a feeder unit to forward the sheets in the stack in the sheet feeding path, at least one restrictive member, which is configured to be shifted between a releasing position and a restricting position and restricts a height of the stack of sheets to be stored in the sheet cassette when in the restricting position, a shifting unit to shift the positions of the at least one restrictive member. The shifting unit shifts the at least one restrictive member to be in the restricting position when the sheet cassette is removed from the body and to be in the releasing position when the sheet cassette is installed in the body.

According to the above configuration, when he sheet cassette is removed from the body in order to have the stack of sheets refilled therein, the restricting member is shifted in the restricting position. Therefore, an excessive amount of sheets is restricted from being set in the sheet cassette by the restrictive member in the restriction position.

BRIEF DESCRIPTION OF THE ACCOMPANYING DRAWINGS

DETAILED DESCRIPTION

Hereinafter, embodiments according to aspects of the present invention will be described with reference to the accompanying drawings.

Figure 1:
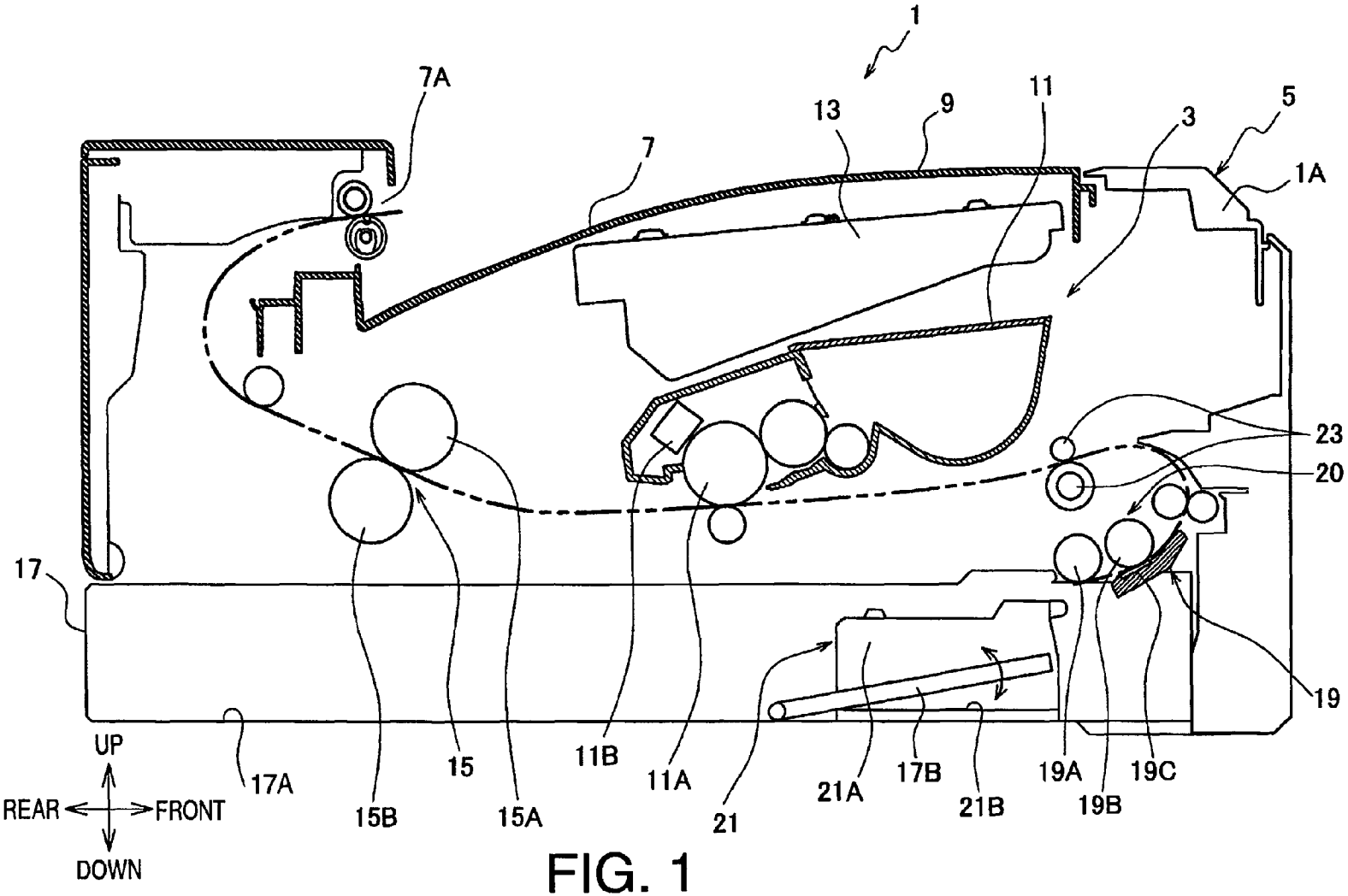
FIG. 1 is a cross-sectional side view of a laser printer according to a first embodiment of the present invention.

FIG. 1 is a cross-sectional side view of a printer 1 according to a first embodiment of the present invention. The printer 1 is a laser printer for monochrome laser printing and includes an image forming unit 3, which is configured to transfer a latent image to a surface of a recording sheet, develop the transferred image, and fix the developed image on the recording sheet. The recording sheet with the image formed thereon is conveyed in a sheet feeding path, which is indicated by a double-dotted line, to be discharged and received in a discharge tray 7.

The image forming unit 3 includes a processing cartridge 11, a laser emitter unit 13, and a fixing unit 15. The processing cartridge 11, the laser emitter unit 13, and the fixing unit 15 are housed in a body 1A of the printer 1. The body 1A includes a casing 5 and frames (not shown). The frames are reinforcing parts of the body 1A of the printer 1 and covered with the casing 5.

A feeder device 20 includes a sheet cassette 17, which is detachably attached onto a bottom of the casing 5 to store a stack of recording sheets, and a feeder unit 19. The feeder unit 19 includes a sheet pickup roller 19A, a separator roller 19*b*, and a sheet separator pad 19C, which are provided above one end of the sheet cassette 17. When an image is formed, a topmost sheet in the stack of the recording sheets in the sheet cassette 17 is separated from the stack by the sheet pickup roller 19A, the separator roller 19*b*, and the sheet separator pad 19C and straighten its orientation by a pair of register roller 23 with respect to the sheet feeding path. Further, the recording sheet is conveyed to the processing cartridge 11. Configuration of the feeder device 20 will be described later in detail.

In the processing cartridge 11, a latent image is transferred to the recording sheet, which is conveyed to the fixing unit 15. The latent image is fixed by heat onto the recording sheet in the fixing unit 15. The recording sheet is thereafter turned approximately 180 degrees toward the upper direction and discharged out of the printer 1.

The processing cartridge 11 includes a photosensitive drum 11A and a charger 11B to electrically charge a surface of the photosensitive drum 11A. The surface of the photosensitive drum 11A is charged by the charger 11B according to image data exposed to the laser beam emitted from the laser emitter unit 13 so that a latent image is formed on the surface of the photosensitive drum 11A. As the photosensitive drum 11A with the latent image is rotated, developer toner positively charged is provided and adhered to lower-potential regions, which correspond to the latent image, on the surface of the photosensitive drum 11A. Thus, the latent image is developed to be a reversed toner image on the photosensitive drum 11A. The reversed toner image is transferred onto the surface of the recording sheet when the recording sheet passes between the photosensitive drum 11A and a pairing roller.

The fixing unit 15 includes a heat roller 15A and a pressure roller 15B. The heat roller 15A includes a heat source (not shown), and the toner image transferred onto the recording sheet is fixed thereto by the heat from the heat roller 15A when the recording sheet passes in between the heat roller 15A and the pressure roller 15B, which is pressed to be in contact with the heat roller 15A.

Figure 2:
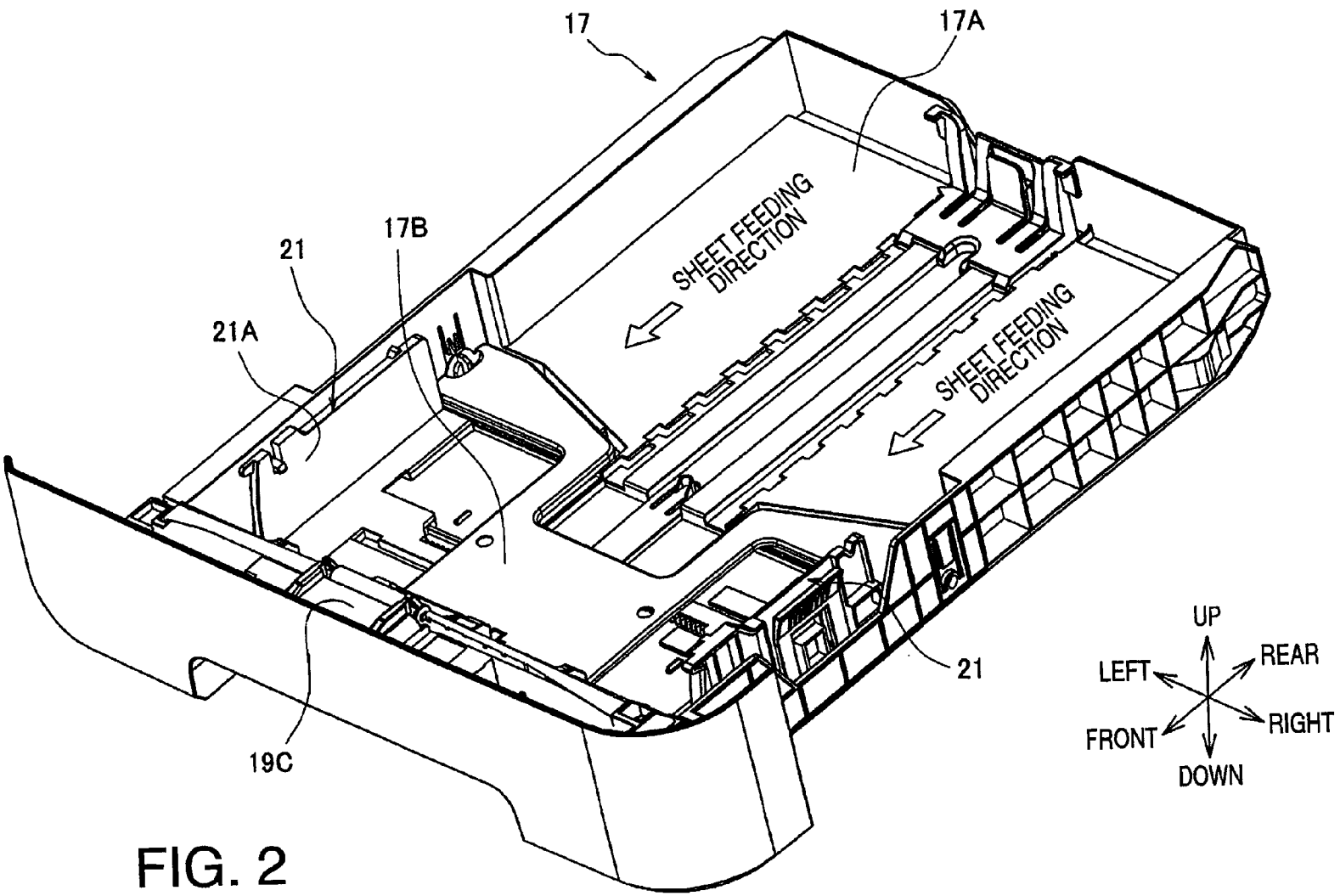
FIG. 2 is a perspective view of a sheet cassette to be installed in the laser printer according to the first embodiment of the present invention.

The configuration of the feeder device 20 will be described with reference to FIG. 2. FIG. 2 is a perspective view of the sheet cassette 17 to be installed in the printer 1 according to the first embodiment of the present invention.

The sheet cassette 17 according to the present embodiment includes a sheet tray 17A, in which a stack of recording sheets is placed, and a holder plate 17B, which holds the recording sheets in the sheet tray 17A uplifted toward the feeder unit 19.

The holder plate 17B is fixed to a bottom of the sheet tray 17A at one end (i.e., a rear end with respect to the sheet feeding path). The opposite end of the holder plate 17B (i.e., a front end with respect to the sheet feeding path) is rotatably uplifted higher by expanding force as a number of the recording sheets remaining in the sheet tray 17A decreases. Thus, the front end of the recording sheets in the sheet tray 17A is held uplifted toward the feeder unit 19 (i.e., the sheet pickup roller 19A) so that the front end of the recording sheets is lead to reach the feeder unit 19. The front end of the recording sheets refers to a side perpendicular to the sheet feeding path and corresponds to a widthwise direction. The widthwise direction is perpendicular to the sheet feeding direction and to a thickness direction of the recording sheets. In the present embodiment, the widthwise direction corresponds to the right-left direction of the printer 1 and the sheet cassette 17 (see FIG. 2).

The feeder unit 19 includes the sheet pickup roller 19A, the separator roller 19B, and the sheet separator pad 19C to pick up the topmost recording sheet in the stack set in the sheet tray 17A. The picked-up recording sheet is forwarded to the register rollers 23.

Figure 3A:
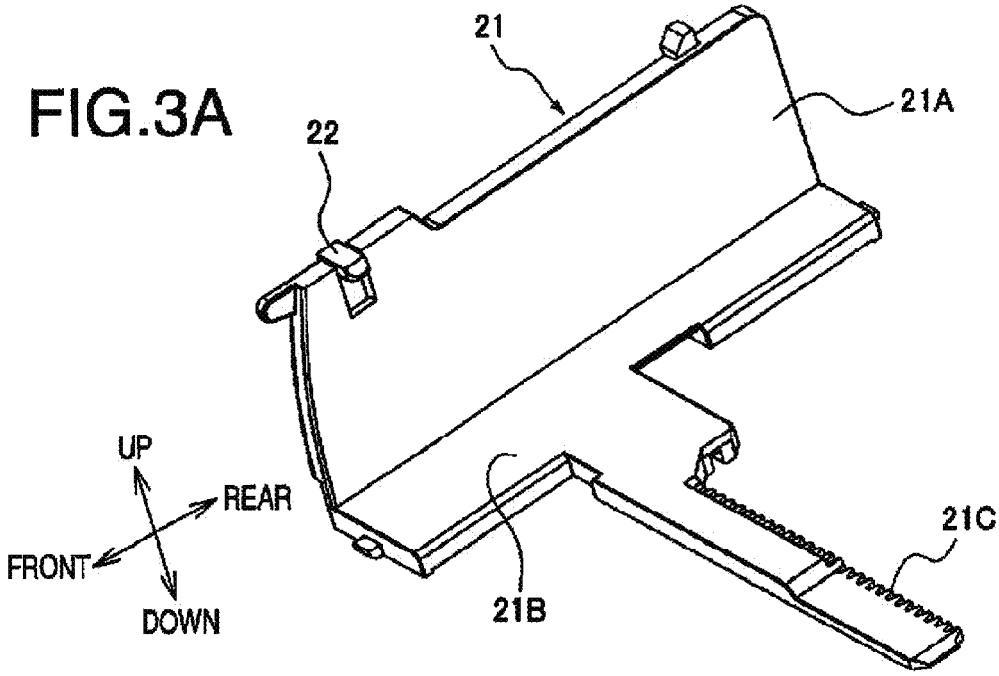
FIGS. 3A and 3B are perspective views of a side guide with a restrictive piece in the laser printer according to the first embodiment of the present invention.
Figure 3B:
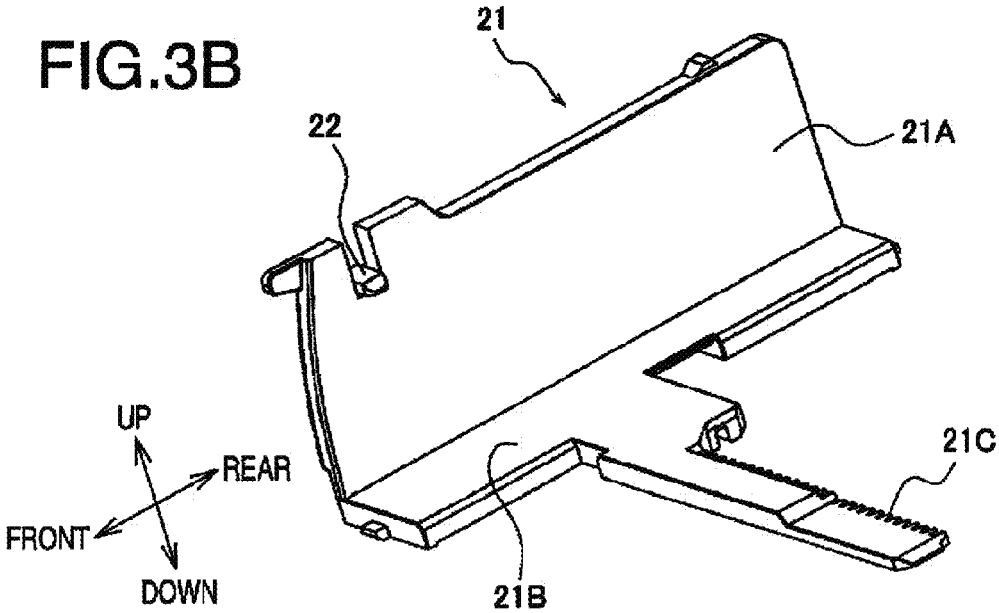

The sheet cassette 17 is provided with a pair of side guides 21, which guide the recording sheet to be fed in the sheet feeding path. FIGS. 3A and 3B show perspective views of one of the side guides 21 to be installed in the sheet cassette 17 according to the embodiment of the present invention. The side guide 21 includes a guide wall 21A and a base portion 21B. The guide wall 21A extends upwardly in a direction of the recording sheets to be stacked (i.e., a thickness direction) from the base portion 21B to become in contact with a crosswise end of the recording sheets. The crosswise end refers to a side of the recording sheets which extends in parallel with the sheet feeding direction when the recording sheets are in the sheet cassette 17. The base portion 21B extends perpendicularly with respect to the guide wall 21B.

The base portion 21B of the side guide 21 is installed on a bottom portion of the sheet tray 17A in the sheet cassette 17. The base portion 12B includes a rack gear 21C, which is movable in synchronization with a rack gear (not shown) of a counterpart side guide 21 on the other side in the sheet cassette 17. The rack gear 21C is engaged with a pinion gear (not shown), which is also engaged with the rack gear of the counterpart side guide 21. According to the engaged motions of the rack gears 21C and the pinion gear, the side guides 21 can be slid in the widthwise direction in the sheet tray 17 with a median point therebetween maintained steady to be fitted to the crosswise ends of the recording sheets.

The side guides 21 are arranged in positions closer to the position of the feeder unit 19, which is in the vicinity of the front end of the sheet cassette 17 (see FIG. 1). Further, each side guide 21 is formed to have a restrictive piece 22 on an upper edge of the guide wall 21A (see FIGS. 3A and 3B). The restrictive piece 22 restricts height of the stack of sheets to be set in the sheet tray 17A so that a volume of the stack is limited to a predetermined volume or lower.

FIG. 3A illustrates a perspective view of the side guide 21 with the restrictive piece 22 in a releasing position, and FIG. 3B illustrates a perspective view of the side guide 21 with the restrictive piece 22 in a restricting position, which is closer to the upper edge of the side wall 21.

Figure 4:
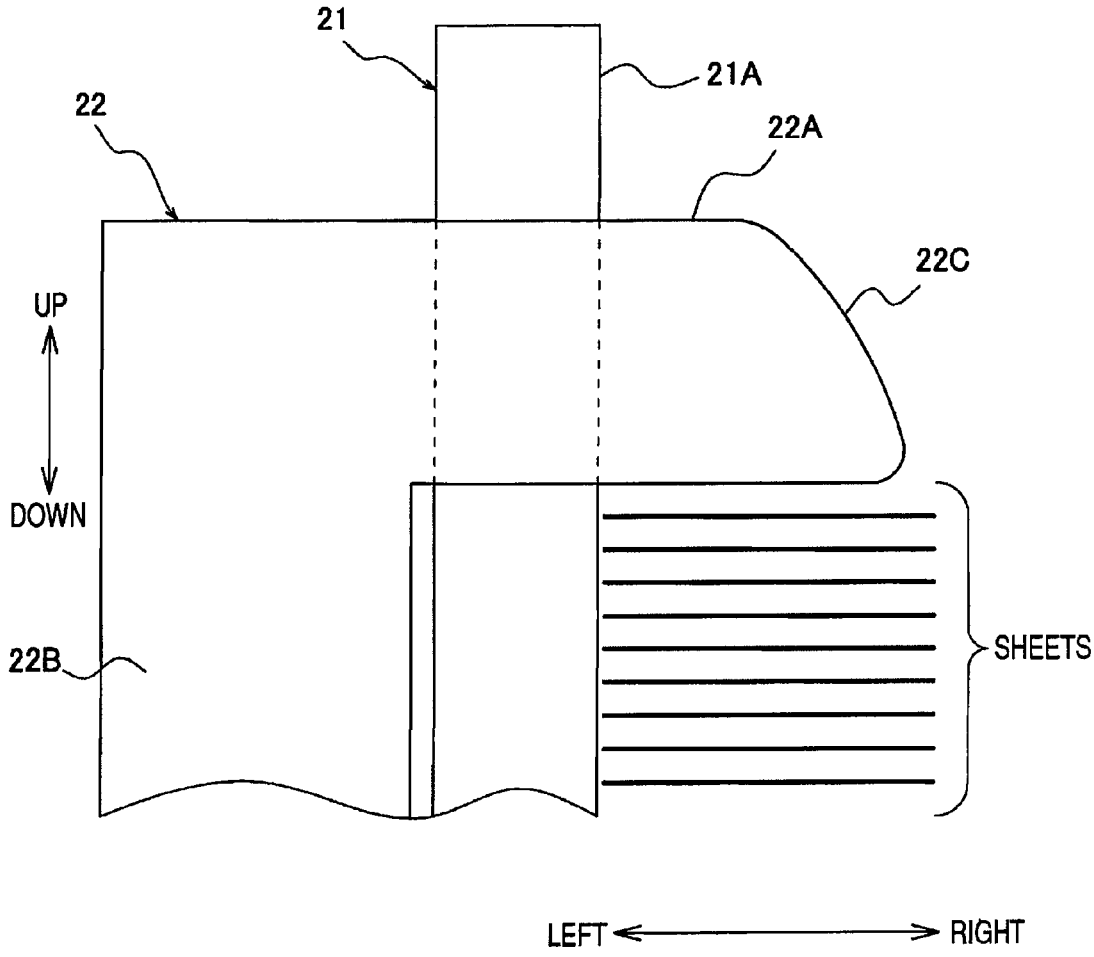
FIG. 4 illustrates an enlarged cross-sectional view of the restrictive piece according to the first embodiment of the present invention.

FIG. 4 illustrates an enlarged cross-sectional view of the restrictive piece 22 according to the first embodiment of the present invention. The restrictive piece 22 is formed to have an approximate shape of L and includes a claw portion 22A, a linker portion 22B, and a tapered portion 22C. The claw portion 22A, at least when the restrictive piece 22 is in the restricting position, projects from the guide wall 21A toward the sheet stack in the sheet tray 17A. The linker portion 22B extends perpendicularly with respect to the projecting direction of the claw portion 22A. The tapered portion 22C is formed at a tip end of the claw portion 22A to be tapered upwardly from a lower level, which is closer to the sheet stack in the sheet tray 17A. When the restrictive piece 22 is in the restricting position (see FIGS. 2 and 3B), the claw portion 22A indicates a maximum height of the sheet stack to be stored in the sheet tray 17A so that an excessive amount of recording sheets can be prevented from being loaded in the sheet tray 17A.

Figure 5:
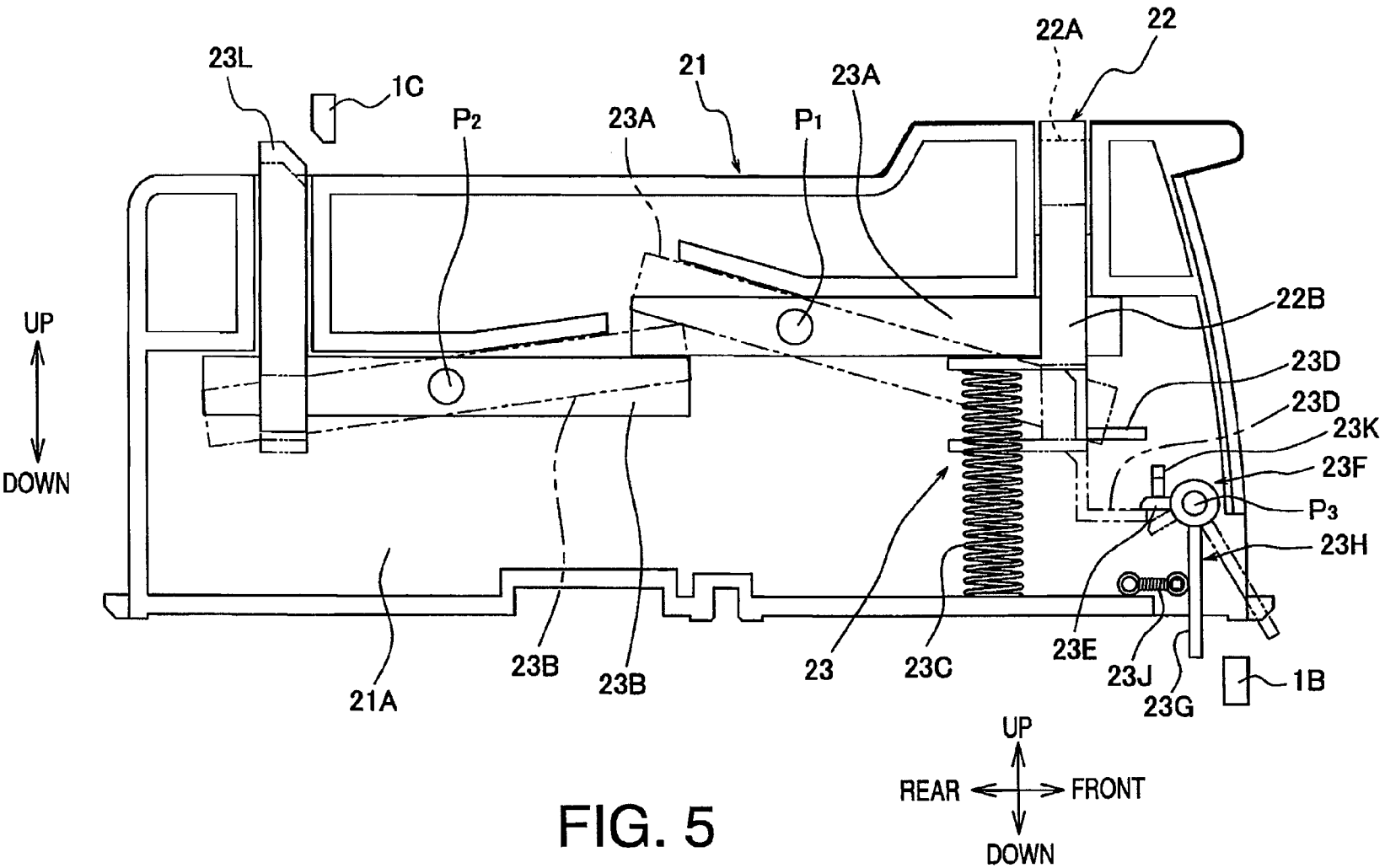
FIG. 5 is a cross-sectional view of a shifting unit according to the first embodiment of the present invention.

According to the present embodiment of the invention, a vertical level of the restrictive piece 22 can be changed by movements of a shifting unit 23. FIG. 5 is a cross-sectional view of the shifting unit 23 according to the first embodiment of the present invention. The shifting unit 23 is provided on an outer surface of the guide wall 21A opposite to the surface which faces the recording sheets stored in the sheet tray 17A. The shifting unit 23 shifts the restrictive piece 22 to the restricting position when the sheet cassette 17 is removed from the body 1A of the printer 1 and to the releasing position when the sheet cassette 17 is set in the body 1A.

The shifting unit 23 according to the present embodiment includes a first lever 23A, a second lever 23B, a resilient spring 23C, and a lock mechanism 23F.

The first lever 23A is swingably pinned to the guide wall 21A at an axis P1, which is an approximate center of a length thereof, and is coupled to the linker portion 22B of the restrictive piece 22 at one end thereof (i.e., at right-hand end in FIG. 5). Therefore, when the first lever 23A is rotated about the axis P1, the restrictive piece 22 is shifted in the vertical direction.

The spring 23 is fixed to a lower edge of the side guide 21 at one end (i.e., at a lower end in the present embodiment) and linked to a lengthwise end of the first lever 23A at the other end (i.e., at an upper end). Expanding force of the spring 23 affects the first lever 23A to shift the restrictive piece 22 upwardly toward the releasing position through the linker portion 22B.

The second lever 23B is swingably pinned to the guide wall 21A at an axis P2, which is an approximate center of a length thereof. The second lever 23 B has a length to substantially reach and partially overlap a left-hand end of the first lever 23A at the right-hand end thereof with the right-hand end of the second lever 23B being lower than the left-hand end of the first lever 23A (FIG. 5). When the second lever 23B in a position indicated by a solid line in FIG. 5 is rotated about the axis P2 in a counterclockwise direction in FIG. 5 into a position indicated by a double-dotted line, the second lever 23B can provide pressure to the first lever 23A to be rotated in a clockwise direction about the axis P1 to shift the restrictive piece 22 downward toward the restricting position through the linker portion 22B.

The lock mechanism 23F includes an engaging arm 23D, a resilient spring 23J, and an approximately L-shaped lock 23H, which is rotatable about an axis P3 and includes an engageable portion 23E and a first arm 23G The engageable portion 23E of the lock 23H can be pressed downwardly according to a downward motion of the engaging arm 23D, which extends downward from the first lever 23A, and the first arm 23G extends downwardly from the axis P3. The spring 23J is fixed to the guide wall 21A of the side guide 21 at one end and to the first arm 23G at the other end, and can be deformed and expanded by the rotation of the first arm 23G in the counterclockwise direction. In this regard, the spring 23J provides contracting force to the first arm 23G The lock mechanism 23F further includes a stopper 23K, which is fixed to the side wall 21A and prevents the lock 23H from being rotated about the axis P3 by the contracting force of the spring 23J in the clockwise direction further than a predetermined necessary rotation amount. The lock mechanism 23F is configured such that, when the engaging arm 23D is shifted downwardly to press an upper surface of the engageable portion 23E, and once the engaging arm 23D is shifted further downwardly to pass by the engageable portion 23E, the engaging arm 23D is held by a lower surface of the engageable portion 23E and restricted from shifted upwardly further than the engageable portion 23E. Thus, the engaging arm 23D is held by the engageable portion 23E to maintain the restrictive piece 22 in the restricting position when the spring 23C is compressed by the linker portion 22B of the restrictive piece 22.

The shifting unit 23 further includes a second arm 23L, which is coupled to left-hand end of the second lever 23B at one lengthwise end thereof. The second arm 23L extends upwardly to the body 1A of the printer 1. The second arm 23L is supported by the guide wall 21A to be slidable in the lengthwise direction thereof.

With the shifting unit 23 in the above configuration, when the second lever 23B is affected by its own weight and weight of the second arm 23L coupled thereto and is not affected by the first lever 23A (i.e., when the restrictive piece 22 is in the restricting position), the second lever 23B rotates about the axis P2 to a position indicated by the double-dotted line in FIG. 5 with the right-hand end thereof being lifted. In this position, the second arm 23L is substantially stored in the guide wall 21A.

When the right-hand end of the second lever 23B is pressed downwardly by the left-hand end of the first lever 23B, the second lever 23B is shifted in the position indicated by the solid line, and the second arm 23L is projected out of the upper edge of the side wall 21A.

Further, when the second arm 23L is pressed downwardly to be in the position indicated by the double-dotted line, the second lever 23B is rotated about the axis P2 to be in the position indicated by the double-dotted line with the right-hand end thereof uplifted to provide uplifting pressure to the left-hand end of the first lever 23A.

In this regard, it is to be noted that the body 1A of the printer 1 is provided with a first projection 1B, which projects toward the guide wall 21A. The first projection 1B interferes with the first arm 23B, when the sheet cassette 17 is set in and removed from the body 1A, to rotate the lock 23H about the axis P3.

Further, the body 1A of the printer 1 is provided with a second projection 1C, which projects toward the guide wall 21A. The second projection 1C interferes with the second arm 23L, when the sheet cassette 17 is set in and removed from the body 1A, to shift the second arm 23L downwardly.

Movements of the shifting unit 23 according to installation and removal of the sheet cassette 17 will be described hereinbelow.

Figure 6A:
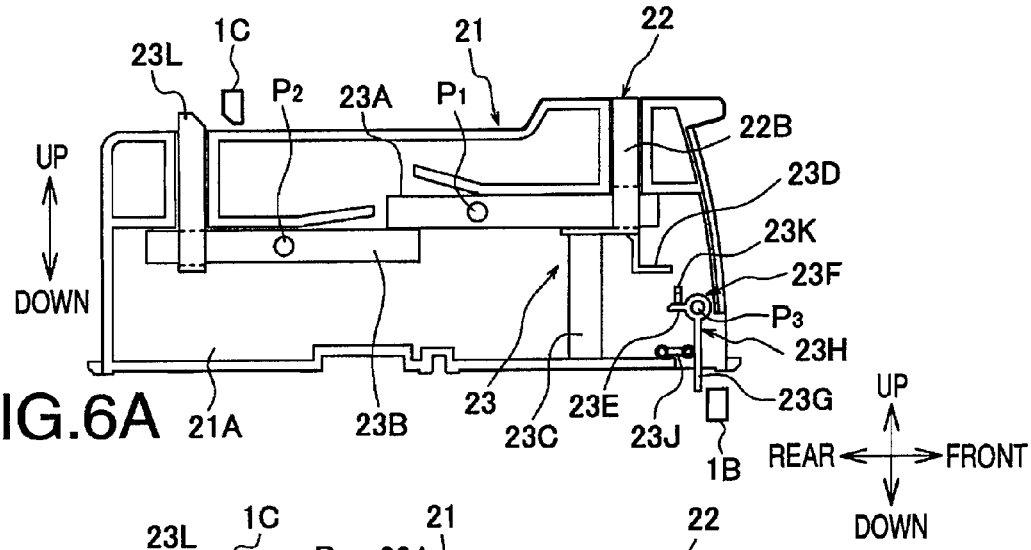
FIGS. 6A-6C illustrate movements of the shifting unit when the sheet cassette is removed from the laser printer according to the first embodiment of the present invention.
Figure 6B:
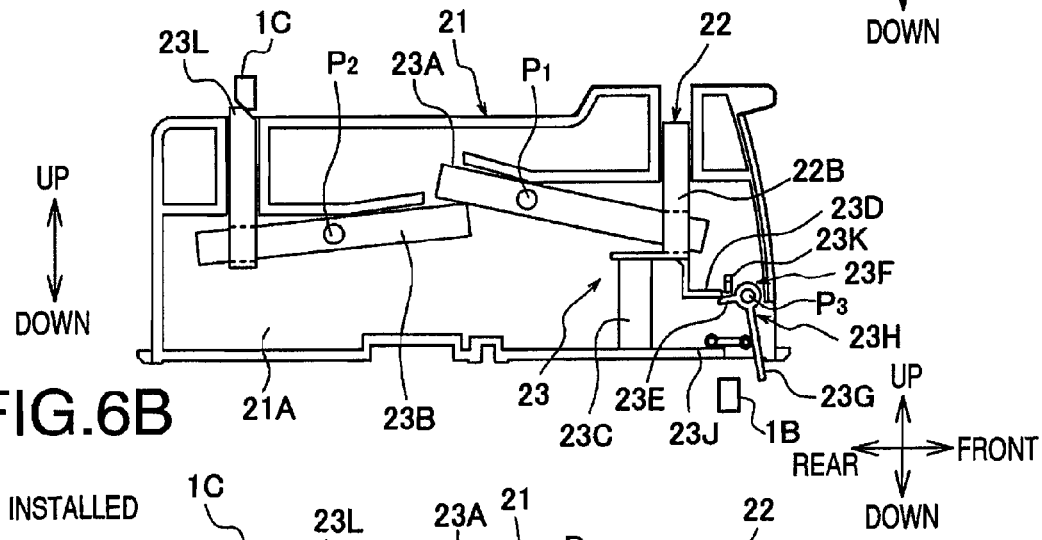
Figure 6C:
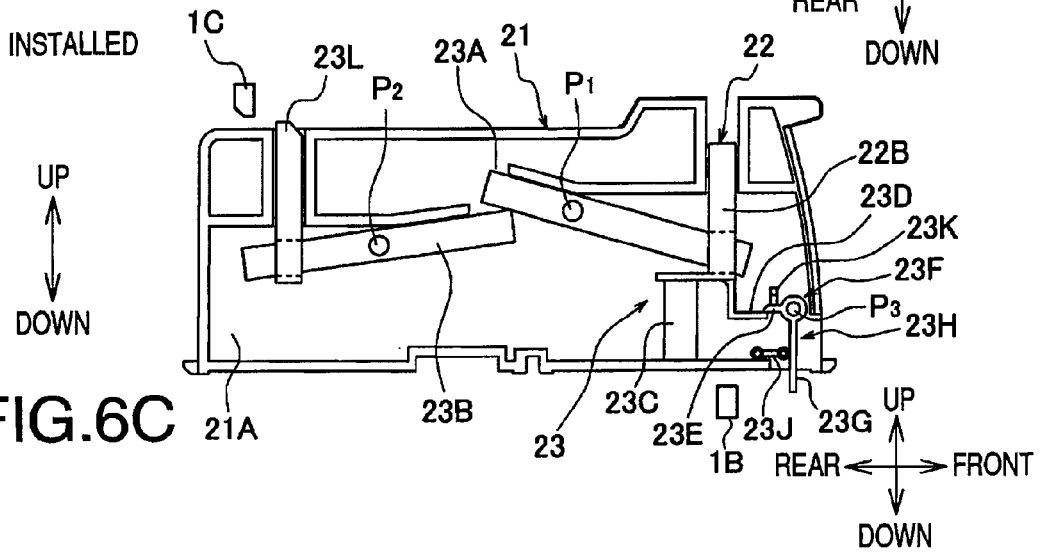

FIGS. 6A-6C illustrate movements of the shifting unit 23 when the sheet cassette 17 is removed from the printer 1 according to the first embodiment of the present invention. When the sheet cassette 17 is set in the body 1A of the printer 1, as shown in FIG. 6A, the linker portion 22B along with the claw portion 22A is maintained uplifted by the expanding force of the spring 23. Therefore, the restrictive piece 22 is in the releasing position. The second arm 23L is projected out of the upper edge of the side wall 21A.

When the sheet cassette 17 set in the body 1A is removed therefrom, as shown in FIG. 6B, the second arm 23L is pressed downward by the projection 1C so that the position of the restrictive piece 22 is lowered as the second lever 23B uplifts the left-hand end of the first lever 23A. Accordingly, the engaging arm 23D presses the pressed portion 23E downwardly, and the first arm 23G is rotated outwardly (counterclockwise in FIG. 6B) to pass over the first projection 1B.

When the engaging arm 23D is shifted further downwardly to pass by the engageable portion 23E, as shown in FIG. 6C, the engaging arm 23D is held by the engageable portion 23E. Accordingly, the restrictive piece 22 is maintained in the restricting position.

When the upper edge of the second arm 23L passes under the second projection 1C, the second arm 23L is released from the pressing force of the second projection 1C. However, the second arm 23L is maintained in the lower position due to the effect of the weight of the second lever 23A and itself. Therefore, the second arm 23L remain stored within the guide wall 21A.

Figure 7A:
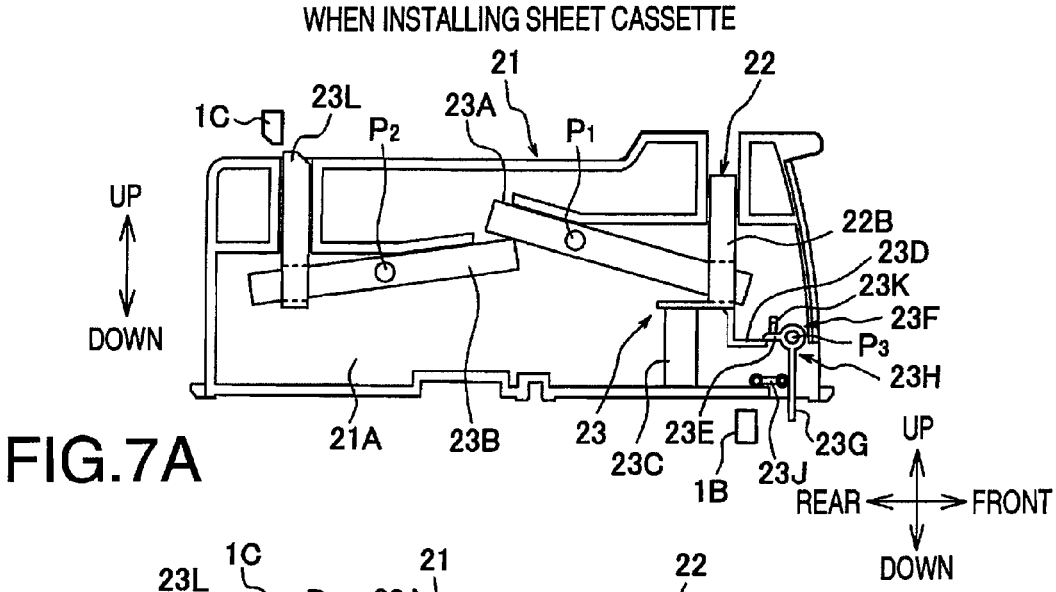
FIGS. 7A-7C illustrate movements of the shifting unit when the sheet cassette is installed in the laser printer according to the first embodiment of the present invention.
Figure 7B:
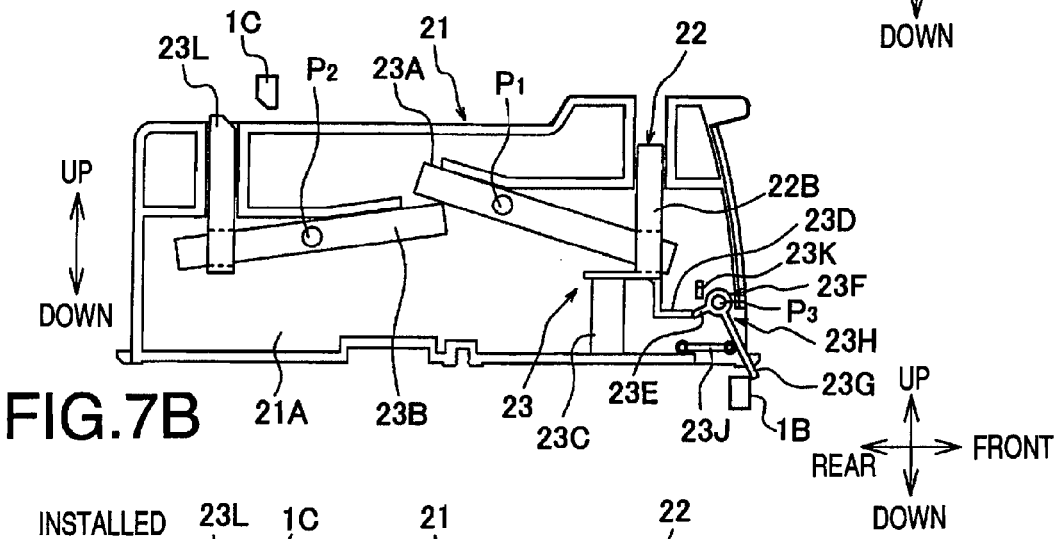
Figure 7C:
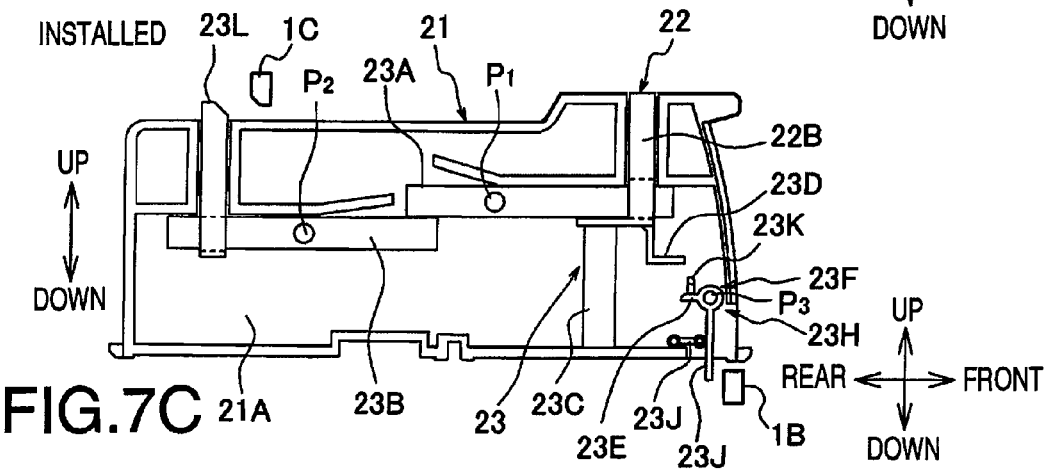

FIGS. 7A-7C illustrate movements of the shifting unit 23 when the sheet cassette 17 is installed in the printer 1 according to the first embodiment of the present invention. When the sheet cassette 17 is outside the body 1A of the printer 1, as shown in FIG. 7A, the restrictive piece 22 is maintained in the restricting position, and the second arm 23L is stored in the guide wall 21A.

When the sheet cassette 17 is installed in the body 1A, as shown in FIG. 7B, a lower portion of the first arm 23G is interfered with the first projection 1B. Accordingly, the lock 23H is rotated in the counterclockwise direction, and the engaging arm 23D is released from the engageable portion 23E.

When the engaging arm 23D is released, as shown in FIG. 7C, the restrictive piece 22 returns to the releasing position due to the expanding force of the spring 23C. Accordingly, the second lever 23B is pressed by the left-hand end of the first lever 23A at the right-hand end thereof, and the second arm 23L is uplifted.

As has been described above, when the sheet cassette 17 is to be loaded with a stack of sheets, that is, when the sheet cassette 17 is removed from the body 1A of the printer 1, the restrictive piece 22 is in the restricting position, which indicates a maximum allowable height of the sheet stack to be stored in the sheet tray 17A. Therefore, an excessive amount of recording sheets can be prevented from being loaded in the sheet tray 17A.

When the sheet cassette 17 with the maximum allowable height of the sheet stack being loaded is installed in the body 1A, it is to be noted that the topmost recording sheet to be fed by the feeder unit 19 may be interfered by the restrictive piece 22 due to the effect of the holder plate 17B. The holder plate 17B shifts the recording sheets in the sheet tray 17A upwardly by the expanding force toward the feeder unit 19 so that the topmost recording sheet can be picked up by the feeder unit 19.

However, according to the present embodiment, when the sheet cassette 17 is installed in the body 1A of the printer 1, the restrictive piece 22 is in the releasing position, which is higher than the restricting position. Therefore, the recording sheets in the sheet tray 17A can be uplifted by the holder plate 17B to be fed by the feeder unit 19 without interference of the restrictive piece 22.

According to the above configuration, the printer 1 can prevent an excessive amount of recording sheets from being loaded and feed the recording sheets securely by the feeder unit 19.

Figure 8:
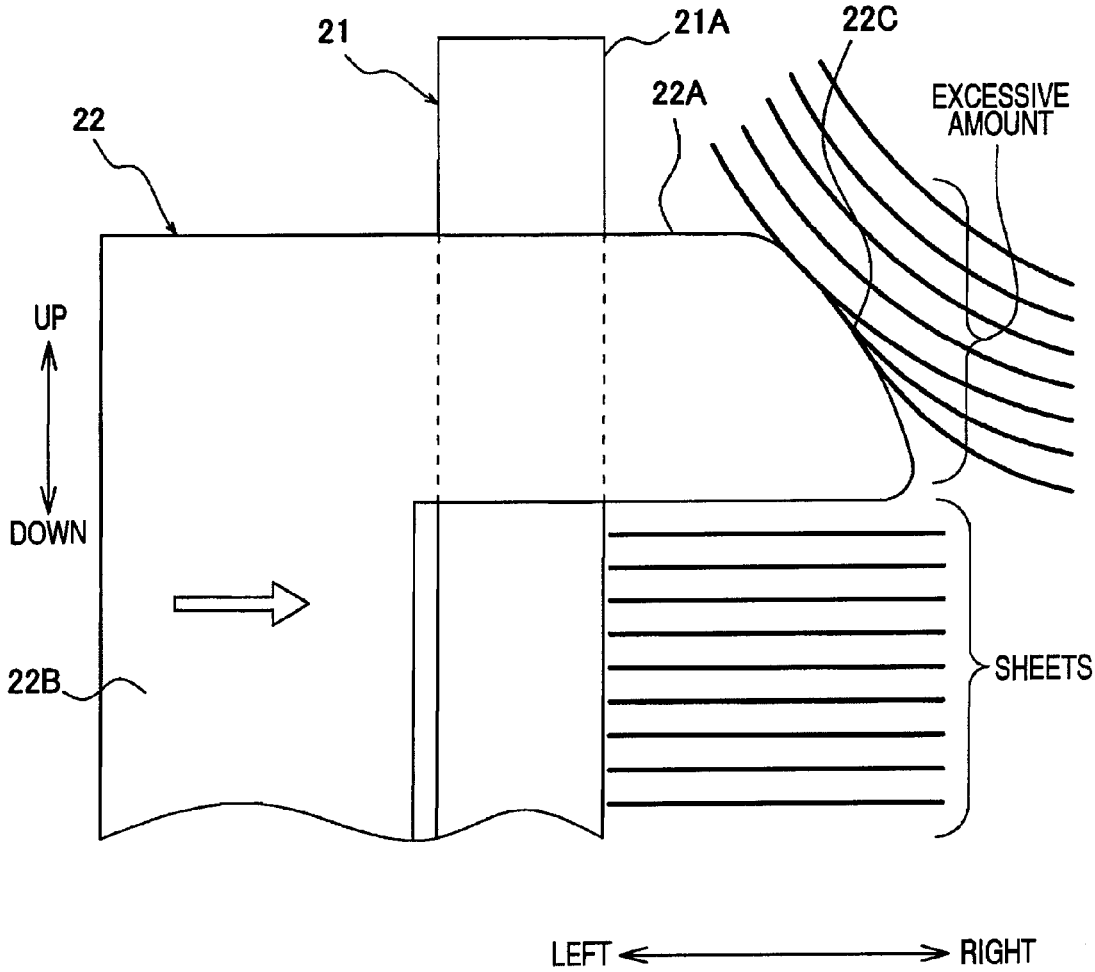
FIG. 8 is a cross-sectional partial view of the restrictive piece with an excessive amount of recording sheets being separated according to the first embodiment of the present invention.

Further, according to the above configuration, it is to be noted that the side guides 21 are slid toward each other to guide the sheet stack in the sheet feeding path. Therefore, when an excessive amount of recording sheets is set in the sheet tray 17A, a portion of the recording sheets exceeding the maximum allowable height is separated from a remaining portion of the recording sheets, which is within the maximum allowable height, by the tapered portions 22C of the restrictive pieces 22. FIG. 8 is a cross-sectional partial view of the restrictive piece 22 with the excessive amount of recording sheets being separated according to the first embodiment of the present invention. Therefore, a user can recognize the overload of the recording sheets. Thus, the exceeding portion of recording sheets can be prevented from being loaded.

Figure 9:
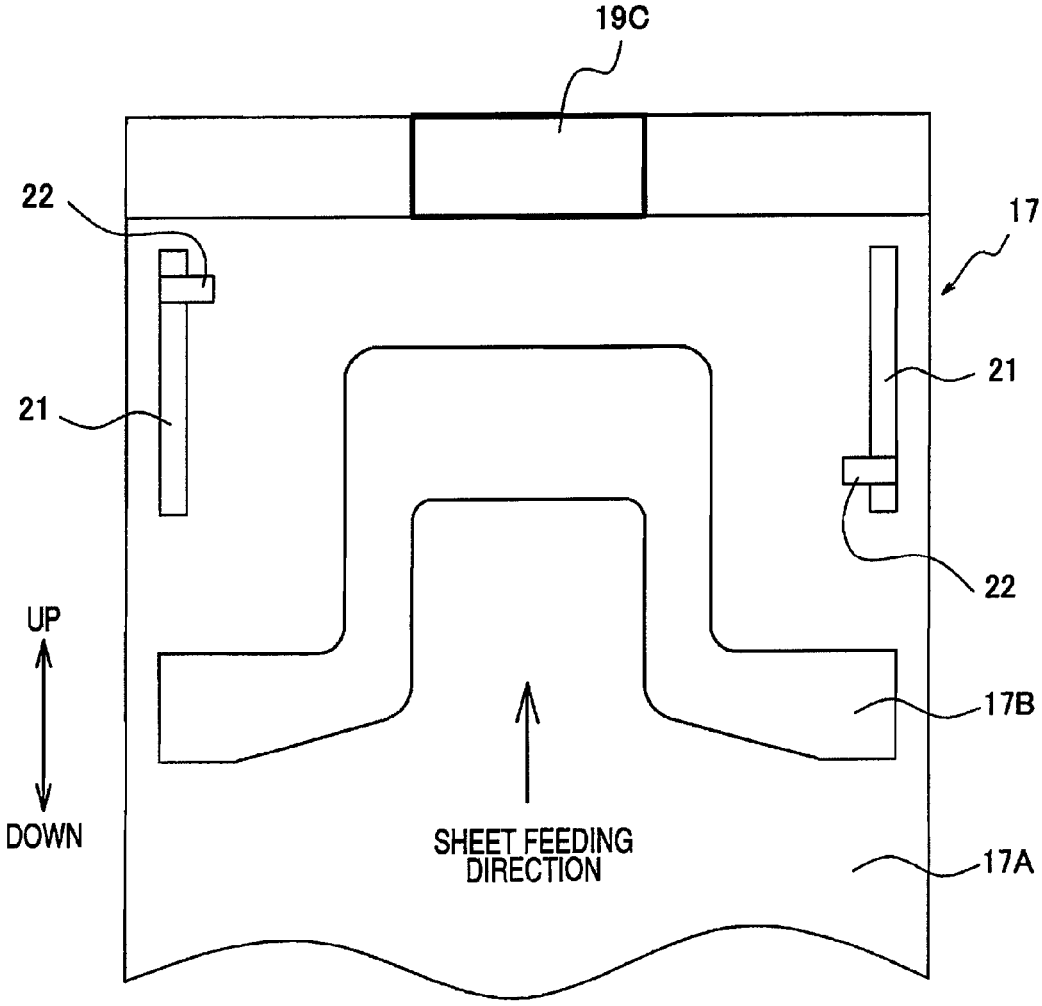
FIG. 9 is a top view of a sheet cassette according to a second embodiment of the present invention.

Next, a second embodiment of the invention will be described. FIG. 9 is a top view of a sheet cassette 17' according to the second embodiment of the present invention. In the sheet cassette 17', one of the restrictive pieces 22 is arranged in a position closer to the separation pad 19C of the feeder unit 19 than the position of the other restrictive piece 22. According to the above arrangement, the recording sheets can be securely stored in within the sheet tray 17A even when the recording sheets are curled.

Although examples of carrying out the invention have been described, those skilled in the art will appreciate that there are numerous variations and permutations of the sheet feeding device and the image forming apparatus that fall within the spirit and scope of the invention as set forth in the appended claims. It is to be understood that the subject matter defined in the appended claims is not necessarily limited to the specific features or act described above. Rather, the specific features and acts described above are disclosed as example forms of implementing the claims.

For example, the restrictive pieces 22 may not necessarily be arranged on the side guides 21, but may be arranged in, for example, the sheet tray 17A.

For another example, the releasing positions of the restrictive pieces 22 may not necessarily be the upper positions with respect to the restricting positions. The restrictive pieces 22 may be movable in the widthwise direction of the recording sheets, and the releasing positions can be set in positions in the widthwise path of the restrictive pieces 22 and displaced from the restrictive positions. Alternatively, the restrictive pieces 22 may be rotatable and can be rotated to release the recording sheets from the restriction when the sheet cassette 17 is installed in the body 1A.

In the above-described embodiments, the shifting unit 23 mechanically shifts the positions of the restrictive pieces 22; however, the restrictive pieces 22 may be moved electrically, for example, by solenoid operations, which can be activated upon installation and removal of the sheet cassette 17. Installation and removal of the sheet cassette 17 can be detected electrically or optically.

For another example, the both side guides 21 may not necessarily be movable in synchronization with each other. One of the side guides 21 may be fixed, and the other of the side guides 21 may be movable with respect to the fixed one. Further, the restrictive pieces 22 may not necessarily be provided in a pair, but at least one restrictive piece 22 may be provided to either one of the side guides 21. Furthermore, the image forming apparatus to which the above-described sheet feeding device is applied is not limited to a laser printer. The sheet feeding device may be applied to, for example, an inkjet printer. Moreover, the sheet feeding device for the image forming apparatus described in the above embodiments can be applied to equipments other than image forming apparatuses which feed sheets.

What is claimed is:

1. A sheet feeding device to feed sheets in a sheet feeding path, comprising:

a sheet cassette, in which a stack of sheets is stored;

a body, in which the sheet cassette is removably installed;

a feeder unit configured to forward the sheets in the stack to the sheet feeding path;

at least one restrictive member, which is configured to be shifted between a releasing position and a restricting position and which restricts a height of the stack of sheets to be stored in the sheet cassette when in the restricting position;

a shifting unit configured to shift the positions of the at least one restrictive member; and wherein the shifting unit shifts the at least one restrictive member to be in the restricting position when the sheet cassette is removed from the body and shifts the at least one restrictive member to be in the releasing position when the sheet cassette is installed in the body, wherein the shifting unit includes a first lever, a second lever and a lock mechanism, wherein the first lever rotates about a first axis and is coupled to the restrictive member at one end thereof such that when the first lever is rotated about the first axis, the restrictive member is shifted in the vertical direction, wherein the second lever is configured to overlap a portion of the first lever and rotates about a second axis to rotate the first lever about the first axis to shift the restrictive member in the vertical direction, wherein the at least one restrictive member has an L-shape and includes:

a projection which is configured to project from a guide wall of the sheet cassette over the stack of sheets in the sheet cassette; and a linker portion which extends perpendicularly with respect to the projecting direction of the projection, wherein the first lever is coupled to the linker portion of the restrictive member at one end thereof, wherein the lock mechanism includes:

an engaging arm;

a resilient spring; and an L-shaped lock which is rotatable about a third axis and includes:

an engageable portion; and a first arm, wherein the engaging arm is configured to be shifted downwardly to press an upper surface of engageable portion, wherein once the engaging arm is shifted downwardly past the engageable portion, the engaging arm is held by a lower surface of the engageable portion and restricted from being shifted upwardly past the engageable portion.

2. The sheet feeding device according to claim 1, wherein the shifting unit includes a second arm which is coupled to the second lever and supported by the guide wall to be slidable in a lengthwise direction, wherein when the sheet cassette is removed from the body, the second arm slides downwardly and rotates the second lever about the second axis to cause the portion of the second lever which overlaps with the first lever to be uplifted and to provide an uplifting pressure on the overlapping portion of the first lever to shift the at least one restricting member downwardly.

3. The sheet feeding device according to claim 2, wherein the body includes a second projection configured to interfere with the first arm when the sheet cassette is installed in and removed from the body and cause the lock mechanism to rotate about the third axis.

4. The sheet feeding device according to claim 1, wherein the projection is configured to project directly over at least one of the sheets of the stack and to be shifted between the releasing position and the restricting position.

5. The sheet feeding device according to claim 1, wherein the feeder unit is provided in vicinity of a front end of the sheets stored in the sheet cassette, the front end of the sheets being front and perpendicular with respect to the sheet feeding direction; and wherein the at least one restrictive member is arranged in a position corresponding to the front end of the sheets stored in the sheet cassette.

6. The sheet feeding device according to claim 5, wherein the at least one restrictive member is arranged in a position corresponding to a crosswise end of the sheets in the sheet cassette; and wherein the crosswise end of the sheets in the sheet cassette is a side being parallel with the sheet feeding direction.

7. The sheet feeding device according to claim 6, comprising:

a pair of restrictive members, each of which is arranged in a position corresponding to each crosswise end of the sheets in the sheet cassette.

8. The sheet feeding device according to claim 7, wherein one of the restrictive members is arranged in a position closer to the front end of the sheets than the other of the restrictive members.

9. The sheet feeding device according to claim 1, further comprising:

a sheet holder to hold the sheets stored in the sheet cassette to be led to the feeder unit, wherein the at least one restrictive member restricts the sheets in the sheet cassette to be moved to a higher position than the restricting position; and wherein the sheets in the sheet cassette are released to be led to the feeder unit by the sheet holder when the at least one restrictive member is in the releasing position.

10. The sheet feeding device according to claim 9, wherein the releasing position is higher than the restricting position with respect to a bottom level of the sheet cassette.

11. The sheet feeding device according to claim 1, wherein the at least one restrictive member is formed to have a claw portion to indicate a maximum allowable height of the stack of sheets to be stored in the sheet cassette.

12. The sheet feeding device according to claim 11, wherein the sheet cassette is provided with at least one side guide, which is movable perpendicularly to the sheet feeding direction to be fitted to the crosswise end of the sheets in the sheet cassette;

wherein the at least one restrictive member is provided to the at least one side guide; and wherein the claw portion of the restrictive member provided to the at least one side guide projects from a wall surface of the at least one side guide.

13. The sheet feeding device according to claim 12, wherein the claw portion of the restrictive member includes a tapered portion, which is tapered upwardly.

14. The sheet feeding device according to claim 1, wherein the lock mechanism is configured to maintain the restrictive member in the restrictive position when the sheet cassette is removed from the body;

wherein the resilient spring is configured to be deformed according to the shifting movements of the restrictive member, the engaging arm is configured to be moved according to the shifting movements of the restrictive member, and the engageable portion to be engaged with the engaging arm is configured to be moved according to the movements of the engaging arm; and wherein the lock mechanism releases the engagement of the engaging arm and the engageable portion so that the restrictive member is shifted in the releasing position when the sheet cassette is installed in the body.

15. An image forming apparatus to form an image on recording sheets, comprising:

the sheet feeding device according to claim 1, further comprising:

a printing unit to print the image on the recording sheets.

16. The sheet feeding device according to claim 1, wherein the at least one restrictive member is positioned at the guide wall of the sheet cassette, wherein when the at least one restrictive member is in the release position, the at least one restrictive member is positioned at an upper edge of the guide wall and when the at least one restrictive member is in the restricting position, the at least one restrictive member is positioned below the release position.

* * * * *